United States Patent [19]

Ichikawa

[11] 4,345,354

[45] Aug. 24, 1982

[54] HINGE MECHANISM

[75] Inventor: Hiroki Ichikawa, Hachioji, Japan

[73] Assignee: Olympus Optical Co., Ltd., Tokyo, Japan

[21] Appl. No.: 122,182

[22] Filed: Feb. 19, 1980

[30] Foreign Application Priority Data

Feb. 26, 1979 [JP] Japan ..... 54-23832[U]

[51] Int. Cl.[3] ..... E05D 7/10

[52] U.S. Cl. ..... 16/257; 16/260

[58] Field of Search ..... 16/141, 150, 171, 225, 16/254, 257, 259, 260, 327, 328, 329, 330, 332

[56] References Cited

U.S. PATENT DOCUMENTS

| | | | |
|---|---|---|---|
| 1,212,475 | 1/1917 | Gillies | 16/329 |
| 2,829,396 | 4/1958 | Kishibay | 16/150 X |
| 2,951,670 | 9/1960 | Aberer | 16/328 X |
| 3,720,979 | 3/1973 | Krawagna | 16/150 |
| 3,931,663 | 1/1976 | Holmes et al. | 16/150 X |

FOREIGN PATENT DOCUMENTS

| | | | |
|---|---|---|---|
| 1551827 | 9/1979 | United Kingdom | 16/150 |

*Primary Examiner*—Wm. Carter Reynolds

*Attorney, Agent, or Firm*—Frishauf, Holtz, Goodman & Woodward

[57] ABSTRACT

This invention relates to a hinge mechanism for joining a first member to a second member. The first member, or a cassette cover of a tape recorder is elastically deformable. A pair of pins are coaxially fixed to the cassette cover. Each one of the pins has a base end fixed to the cassette cover and a free end. The second member, or a housing of the tape recorder has a recess which is defined by a bottom surface and a peripheral surface. A pair of grooves are formed in the housing. Each one of the grooves has an upper end portion which opens in the peripheral surface and rotatably receiving one of the pins. Each one of the grooves also has a lower portion which opens in a portion of surfaces of the second member which is located in the direction of the depth of the recess. A pair of flanges are formed at the base ends of the pins. The cassette cover is rotatably connected to the housing by means of the upper portions of the grooves rotatably receiving the pins and the bottom surface of the housing recess slidably contacted peripheral surfaces of the flanges.

5 Claims, 9 Drawing Figures

HINGE MECHANISM

BACKGROUND OF THE INVENTION

This invention relates to a hinge mechanism for joining first and second members, particularly, to a hinge mechanism comprising an elastically deformable first member, a pair of pins coaxially fixed to the first member, and a second member having a recess and a pair of holes formed in the side surfaces of said recess so as to rotatably receive the pins, wherein the first member is elastically deformed so as to make the distance between free ends of the pins smaller than that between holes and, then, the external force serving to deform the first member is removed so as to put the pins in the holes formed in the side surface of said recess, thereby joining the first and second members.

In the conventional hinge mechanism of the construction described above, it is customary to produce the first and second members by injection molding of a plastic material. In general, the first member and the pins fixed thereto are molded as a single body. Likewise, the second member having a recess and holes for receiving the pins is molded as a single body. It follows that the injection mold for producing the second member is provided with a pair of projections so as to enable the produced second member to have holes serving to receive the pins fixed to the first member.

In general, the injection mold for the second member consists of a plurality of segments because the injection mold must be dismantled in releasing the injection-molded article therefrom. It should be noted in particular that the projections of the injection mold are slid along the axis thereof in releasing the produced molding. Naturally, it takes much time and labor to prepare an injection mold of such a complex structure, leading to a relatively high manufacturing cost of the injection mold. In addition, the injection mold must be assembled and dismantled each time the second member is produced, leading to a relatively low productivity. An additional difficulty to be noted is that the injection-molded article presents an unsatisfactory appearance, because the bottom surface of the recess is caused to bear scratches, which can be seen by the user of the injection-molded article, due to the effect of the projections of the injection mold which are slid along the recess in releasing the molded second member.

SUMMARY OF THE INVENTION

An object of this invention is to provide a hinge mechanism which can be produced by using an injection mold of a simple structure and which presents a satisfactory appearance. The injection mold can be prepared easily at a low cost and permits enhancing the productivity of the hinge mechanism.

DETAILED DESCRIPTION OF THE PREFERRED EMBODIMENTS

Figure 1:
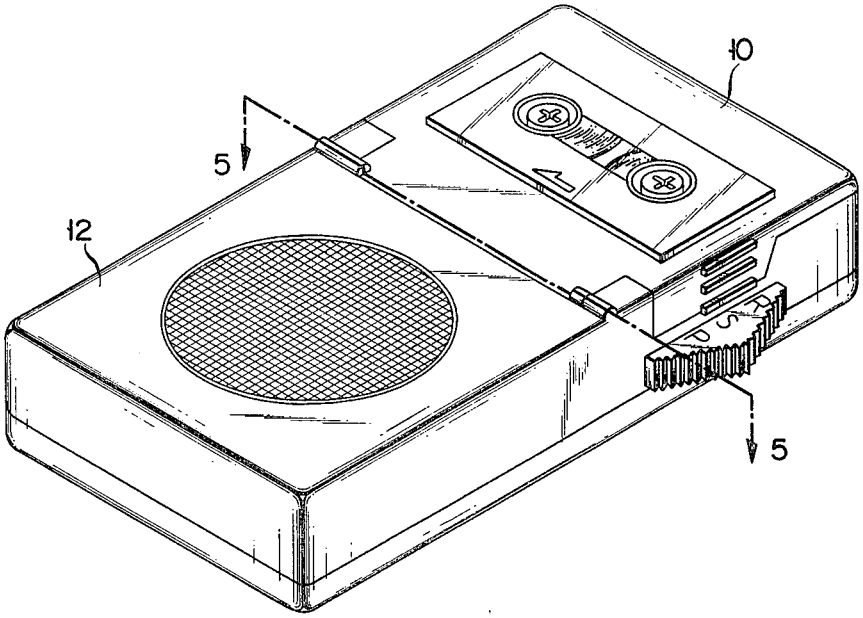
FIG. 1 is a perspective view of a cartridge type tape recorder provided with a hinge mechanism according to one embodiment of this invention.
Figure 2:
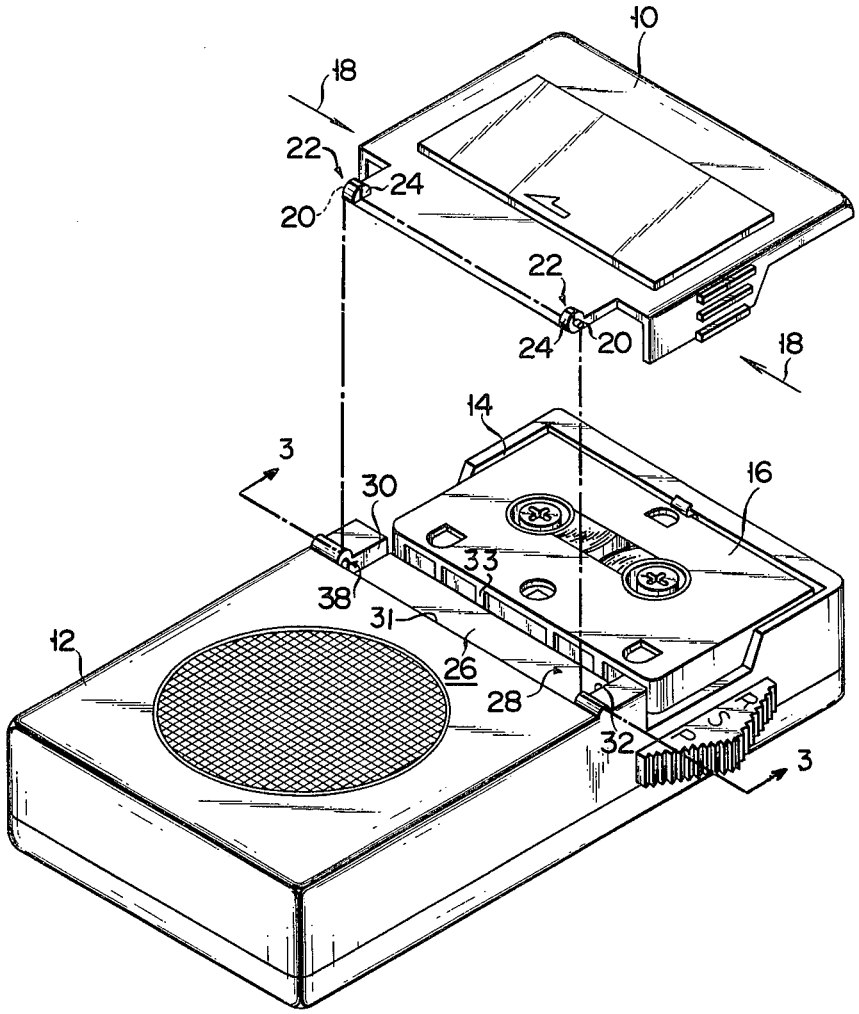
FIG. 2 is an exploded view showing the tape recorder in FIG. 1 with the cassette cover off of the housing.

FIG. 1 shows a cartridge type tape recorder. The tape recorder comprises a cassette cover 10, or a first member of the hinge mechanism, and a housing 12, or a second member of the hinge mechanism. Housed in the housing 12 are various members of the tape recorder such as a loudspeaker, a pair of reel shafts, a capstan, a magnetic head, a pinch roller, a motor, electric circuits and switches (all is not shown). The cassette cover 10, as shown in FIG. 2, serves to prevent dust from entering a recess 14 formed in the housing 12 for receiving a tape cassette 16. The cassette cover 10 also serves to protect the loaded tape cassette 16 from external forces.

The cassette cover 10 is an injection-molded article of a plastic material and, thus, is capable of elastic deformation. Specifically, the cover 10 is elastically an external force is applied thereto as denoted by arrows 18 in FIG. 2. A pair of pins 20 each having a base end and a free end are coaxially fixed to the cassette cover 10 by fixing the base ends to the cover 10. The free ends of pins 20 extend in opposite directions with respect to each other. The pins 20 and the cassette cover 10 are produced as a single body by injection molding of a plastic material. Alternatively, a pair of pins 20 made of metal may be incorporated into the cassette cover 10 in the injection molding step. It is also possible to bond metal pins 20 to the cassette cover 10 molded in advance with an adhesive.

As shown in FIG. 2, a pair of flanges 22 extending in the radial direction of the pins 20 are formed at the base ends of the pins 20. Each of the flanges 22 has a peripheral surface 24. The peripheral surface 24 has a circular cross section which is coaxially arranged with the pins. Incidentally, according to this invention, the peripheral surface 24 is not necessarily circular in cross section. For example, the peripheral surface 24 may have an elliptical cross section. The peripheral surface 24 is made somewhat smoother than the other portion of the flange 22 so as to facilitate the sliding motion of the flange along a material in contact therewith. In this embodiment, the flange 22 and the cassette cover 10 are produced as a single body by injection molding of a plastic material. Alternatively, a single unit of a pin with a flange, which is made of a metal, can be incorporated into the cassette cover 10 in the injection molding step. It is also possible to bond such a single unit to the cassette cover 10 molded in advance with an adhesive.

FIG. 2 shows that the housing 12 is provided in the upper surface with a recess 26 adjacent to the recess 14 for receiving the tape cassette 16. The recess 26 is defined by a bottom surface 28 and a peripheral surface. The peripheral surface comprises side surfaces 30, 32 and a rear surface 31 facing the front surface 33 of the tape cassette 16 loaded in the recess 14. The distance between the side surfaces 30 and 32 is shorter than that between the free ends of the pins 20, but not shorter than that between the outer surfaces of the flanges 22. As seen from FIGS. 3 and 4, the bottom surface 28 of the recess 26 comprises first portions 34 and a second portion 36 deeper than the first portions 34. The first portions 34, which are located adjacent to the side surfaces 30, 32 of the recess 26, are made somewhat smoother than the second portion 36 so as to facilitate the sliding motion of a material in contact therewith. Also, the distance of the inner edge of the first portion 34 from the side surface 30 or 32 is equal to the width of the peripheral surface 24 of the flange 22 as seen from FIG. 3.

Figure 3:
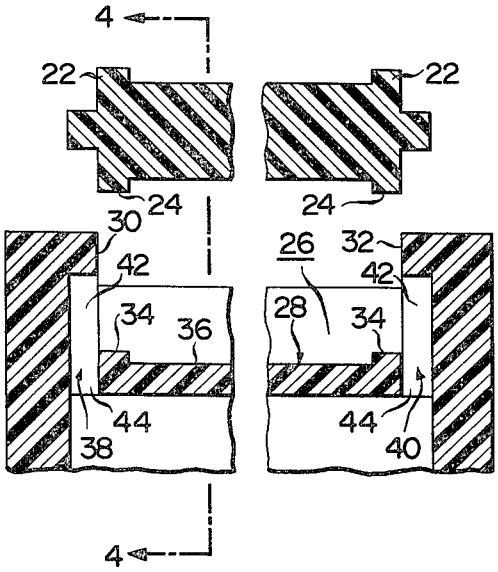
FIG. 3 is a schematic cross sectional view taken along line 3—3 of FIG. 2.
Figure 4:
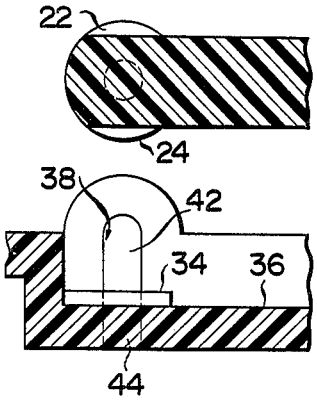
FIG. 4 is a schematic cross sectional view taken along line 4—4 of FIG. 3.

As shown in FIGS. 3 and 4, the side surfaces 30 and 32 of the recess 26 are provided with vertical grooves 38 and 40, respectively, for rotatably receiving the pins 20. Each of the vertical grooves consists of an upper portion 42 and a lower portion 44. The upper portion 42 communicates with the recess 26 above the first portion 34 of the bottom surface 28. Further, the vertical distance between the first portion 34 and the upper end of the vertical groove is substantially equal to the sum of the radius of the pin 20 and the radius of the flange 22. On the other hand, the lower portion 44 of the vertical groove is located under the bottom surface of the recess 26 as seen from FIGS. 3 and 4 and is opened in a portion of surfaces of the housing 22 which is located in the direction of the depth of the recess 26.

Figure 5:
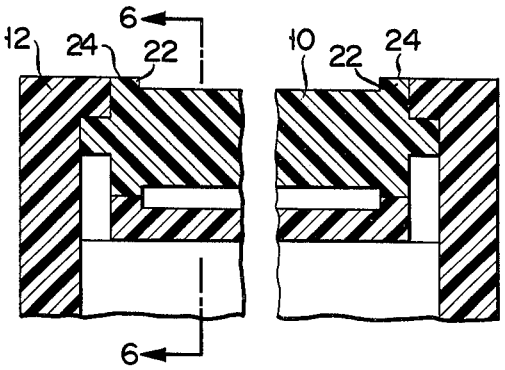
FIG. 5 is a schematic cross sectional view taken along line 5—5 of FIG. 1.
Figure 6:
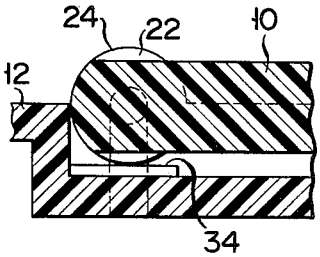
FIG. 6 is a schematic cross sectional view taken along line 6—6 in FIG. 5.

For joining the cassette cover 10 to the housing 12, external force is applied by, for example, fingers to the cover 10 in the direction of arrows 18 shown in FIG. 2 so as to bend the cover 10 and, thus, to shorten the distance between the free ends of the pins 20. Under this condition, the free end portions of the pins 20 are positioned to face the upper portions 42 of the vertical grooves 38, 40. Then, the external force serving to bend the cassette cover 10 is removed so as to allow the free end portions of the pins 20 to be engaged rotatably with the upper portions 42 of the vertical grooves 38, 40 as shown in FIGS. 5 and 6. When the cassette cover 10 has been joined to the housing 12 in this fashion, the peripheral surface 24 of the flange 22 slidably contacts the first portion 34 of the bottom surface 28.

As described previously, the vertical distance of the upper portion 42 of the vertical groove, i.e., the vertical distance between the first portion 34 of the bottom surface 28 and the upper end of the vertical groove is substantially equal to the sum of the radius of the pin 20 and the radius of flange 22. It follows that the cassette cover 10 does not make vertical vibrations relative to the housing 12 when the cover is swung about the joining portion. Incidentally, the vertical distance of the upper portion 42 mentioned above can be made somewhat longer than that of the sum mentioned above as long as the vertical vibration mentioned is not serious.

Figure 8:
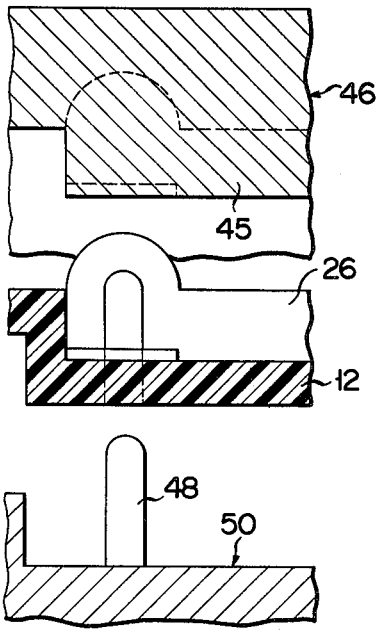
FIG. 8 is a schematic cross sectional view taken along line 8—8 of FIG. 7.
Figure 7:
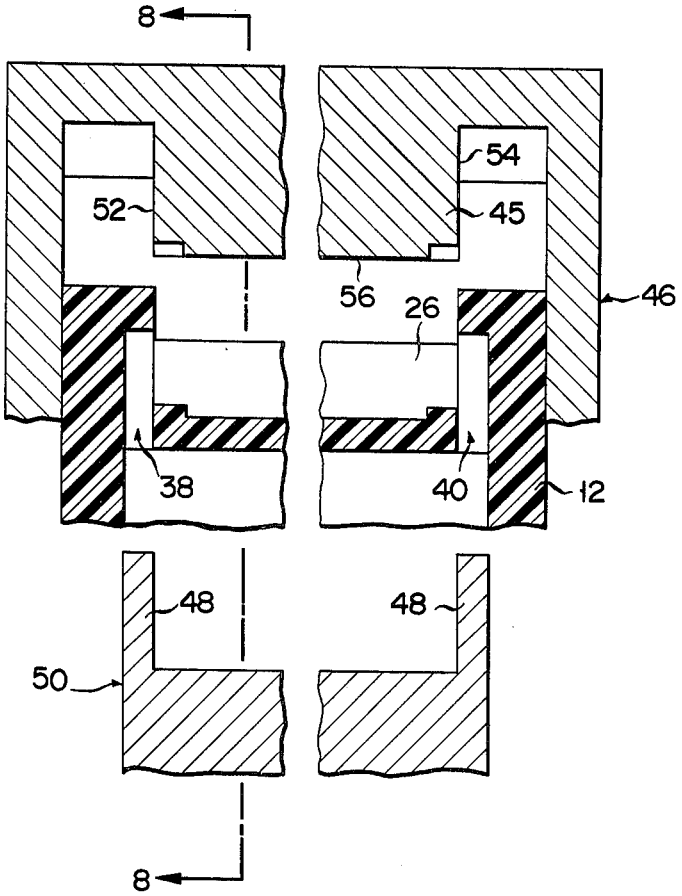
FIG. 7 is a cross sectional view showing how an injection mold is released from the housing after an injection molding by using the cross section of FIG. 2.
Figure 9:
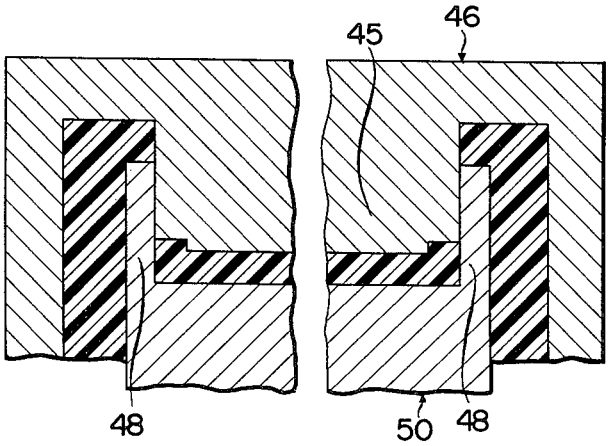
FIG. 9 is a schematic cross sectional view showing how the injection mold shown in FIG. 7 is assembled for performing injection molding.

The housing 12 is produced by injection molding of a plastic material by using an injection mold described in the following. FIGS. 7 and 8 show that the injection mold consists of a first half 46 having a first projection 45 corresponding to the recess 26 of the housing 12 and a second half 50 having a pair of second projections 48 corresponding to the vertical grooves 38, 40 of the housing 12. The first projection 45, which extends vertically downward as shown in FIG. 7, of the first half 46 is defined by side surfaces 52, 54 corresponding to the side surfaces 30, 32 of the recess 26 formed in the housing 12 and a stepped bottom surface 56 corresponding to the bottom surface 28 of the recess 26. It is important to note that horizontal projections are not included in the first half 46. The second projection 48 of the second half 50 extends vertically upward and does not comprise a horizontally projected portion. For performing injection molding, the first and second halves of the injection mold are arranged such that the side surfaces 52, 54 of the first projection 45 of the first half 46 are brought into contact with the inner surfaces of the second projections 48 of the second half 50 as shown in FIG. 9. The produced injection-molded article, i.e., the housing 12, can be easily released from the injection mold by simply moving the first and second halves of the mold vertically as seen from FIGS. 7 and 8.

As described in detail, the hinge mechanism of this invention for rotatably joining first and second members comprises: an elastically deformable first member; a pair of pins coaxially disposed on the first member and having base ends disposed on the first member and free ends extended in opposite directions each other; a second member having a bottom surface and a peripheral surface both of which define a recess, and a pair of grooves each having first end portion opened in the peripheral surface and rotatably receive one of the pins and having second end portion opened in a portion of surfaces of the second member which is located in the direction of the depth of the recess; and a contact means disposed on the first member and extending in the radial direction of the pins and having a peripheral surface which slidably contacts the bottom surface. When the pins have been rotatably engaged with the first end portions of the grooves so as to rotatably connect the first and second members, the peripheral surface of the contact means is allowed to slidably contact the bottom surface of the recess formed in the second member. The particular construction outlined above permits using an injection mold of a simple structure for producing, particularly, the second member by injection molding. Naturally, the injection mold can be prepared in a shorter time at a lower cost. In addition, the injection mold can be assembled and dismantled easily. In particular, the molded second member can be readily released from the injection mold. It follows that the injection mold used in this invention permits enhancing the productivity of the hinge mechanism. It should also be noted that the injection mold need not be slid along the bottom surface of the recess in releasing the molded second member from the injection mold, resulting in that the bottom surface does not bear scatches and, thus, the appearance of the molded second member is not impaired.

This invention is not restricted to the embodiment described above. It is of course possible to make various modifications within the technical scope of this invention. For example, the pair of flanges 22 may be replaced by a single flange formed on the cassette cover 10 at the center of the distance between the pins 20. In this case, the contact area between the peripheral surface of the flange and the bottom surface of the recess is decreased when the pins are rotatably engaged with the grooves, rendering it possible to swing the cassette cover 10 with a very small force, though pitching tends to occur along the common axis of the pins 20. It is also possible to form a flange covering the entire region between the base ends of the pins 20. This modification is just opposite to the former modification in the merit and demerit. In addition, the latter modification necessitates a greater force for elastically bending the cassette cover 10.

In the embodiment shown in the accompanying drawings, the bottom surface 28 of the recess 26 consists of the first portions 34 and the second portion 36 differing from the first portions 34 in depth. However, the bottom surface 28 may be made uniform in depth, though this modification necessitates a somewhat higher manufacturing cost of the injection mold. Specifically, it is necessary in this modification to allow the entire bottom surface to have a smoother surface for facilitating the sliding motion of a material in contact therewith. In other words, where the first portions 34 alone of the bottom surface are allowed to contact the peripheral surfaces 24 of the flanges 22 as in the embodiment shown in the accompanying drawings, it is possible to produce an injection mold at a lower cost.

Further, the cassette cover 10 need not be restricted to the injection-molded article of a plastic material as far as the cassette cover is capable of elastic deformation. Still further, the housing 12 may be an injection-molded article of a metal in place of an injection-molded article of a plastic material.

What is claimed is:

1. A hinge mechanism comprising:

an eleastically deformable first member;

a pair of pins coaxially and integrally mounted on said first member and having base ends disposed on said first member and free ends extended in opposite directions relative to each other;

said first member being elastically deformable to reduce the distance between said free ends of said oppositely extending pins;

a second member made by an injection molding and having a bottom surface and a pair of side surfaces on opposite sides of said bottom surface, said bottom and side surfaces at least partially defining a recess, and a pair of grooves each having a first end portion opening only in a respective said side surface of said recess and each rotatably receiving one of said pins, each groove further having a second end portion opening in a portion of surfaces of said second member which is located in the direction of the depth of said recess, said grooves being closed on the respective sides thereof opposite said recess; and a pair of flanges located at said base ends of said pins, each flange having a peripheral surface having a substantially circular cross section which is coaxially arranged with said pins and slidably contacting with said bottom surface of said second member;

whereby said pins are received in said first portions of said grooves by applying an external force to deform said first member to reduce the distance between the free ends of said pins so as to make the distance between said free ends of said pins less than the distance between said first portions of said grooves, aligning said free ends of said pins with said grooves and then removing said external force from said first member so that said first member is rotatably connected to said second member by said pins received in said first portions of said grooves and said bottom surface which slidably contacts with said peripheral surfaces of said flanges.

2. The hinge mechanism of claim 1, wherein said first member is an injection-molded article of a plastic material.

3. The hinge mechanism of claim 1 or 2, wherein said bottom surface has a first portion slidably contacting with said peripheral surfaces of said flanges; and a second portion deeper than said first portion and which does not contact with said peripheral surfaces of said flanges.

4. The hinge mechanism of claim 3, wherein opposite sides of said bottom surface of said second member, said grooves are open at the ends thereof opposite said first end portions thereof, said first portion of said bottom surface of said second member effectively serving as the bottom of the respective groove which is adjacent thereto to effectively close the open bottom groove.

5. The hinge mechanism of claim 1, wherein said side surfaces in opposite sides of said bottom surface of said second member, said grooves are open at the ends thereof opposite said first end portions thereof.

* * * * *

UNITED STATES PATENT AND TRADEMARK OFFICE

CERTIFICATE OF CORRECTION

PATENT NO. : 4,345,354

DATED : August 24, 1982

INVENTOR(S) : Hiroki ICHIKAWA

It is certified that error appears in the above—identified patent and that said Letters Patent is hereby corrected as shown below:

Column 2, line 30, change "is elastically an" to --is elastically bent if an--;

Column 5, line 26, change "eleastically" to --elastically--;

Column 6, lines 32 and 33, delete "opposite sides of said bottom surface of said second member,";

Column 6, lines 38 and 39, delete "said side surfaces in opposite sides of said bottom surface of said second member,".

Signed and Sealed this

Eighteenth Day of January 1983

[SEAL]

Attest:

GERALD J. MOSSINGHOFF

Attesting Officer

Commissioner of Patents and Trademarks